US008248234B2

(12) United States Patent
Nielsen et al.

(10) Patent No.: US 8,248,234 B2
(45) **Date of Patent: *Aug. 21, 2012**

(54) METHODS AND APPARATUS TO DETECT CARRYING OF A PORTABLE AUDIENCE MEASUREMENT DEVICE

(75) Inventors: Christen V. Nielsen, Palm Harbor, FL (US); Daniel J. Nelson, Tampa, FL (US)

(73) Assignee: The Nielsen Company (US), LLC, Schaumburg, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/232,728

(22) Filed: Sep. 14, 2011

(65) Prior Publication Data

US 2012/0011528 A1 Jan. 12, 2012

Related U.S. Application Data

(63) Continuation of application No. 12/260,775, filed on Oct. 29, 2008, now Pat. No. 8,040,237.

(51) Int. Cl.
*G08B 1/08* (2006.01)

(52) U.S. Cl. ..... 340/539.13; 455/2.01; 725/9

(58) Field of Classification Search ..... 340/539.13, 340/555, 573.1; 725/9–12; 455/2.01
See application file for complete search history.

(56) References Cited

U.S. PATENT DOCUMENTS

| | | | |
|---|---|---|---|
| 4,141,119 | A | 2/1979 | Nodo |
| 5,253,292 | A | 10/1993 | Fluder et al. |
| 5,483,276 | A | 1/1996 | Brooks et al. |
| 5,980,246 | A | 11/1999 | Ramsay et al. |
| 6,115,620 | A | 9/2000 | Colonna et al. |
| 6,229,445 | B1 | 5/2001 | Wack |
| 6,703,981 | B2 | 3/2004 | Meitzler et al. |
| 6,774,796 | B2 | 8/2004 | Smith |
| 6,890,285 | B2 | 5/2005 | Rahman et al. |
| 7,034,282 | B2 | 4/2006 | Oka et al. |
| 7,311,665 | B2 | 12/2007 | Hawthorne et al. |
| 7,373,820 | B1 | 5/2008 | James |
| 7,623,823 | B2 | 11/2009 | Zito et al. |
| 2003/0005430 | A1 | 1/2003 | Kolessar |
| 2003/0171833 | A1 | 9/2003 | Crystal et al. |
| 2004/0019463 | A1 | 1/2004 | Kolessar et al. |
| 2004/0214594 | A1 | 10/2004 | Holman, IV |
| 2005/0200476 | A1 | 9/2005 | Forr et al. |
| 2005/0203798 | A1 | 9/2005 | Jensen et al. |
| 2005/0234774 | A1 | 10/2005 | Dupree |
| 2005/0243784 | A1 | 11/2005 | Fitzgerald et al. |
| 2005/0268798 | A1 | 12/2005 | Neuhauser et al. |
| 2005/0272015 | A1 | 12/2005 | Jensen et al. |
| 2005/0272016 | A1 | 12/2005 | Jensen et al. |

(Continued)

OTHER PUBLICATIONS

The United States Patent and Trademark Office, Notice of Allowability, for corresponding U.S. Appl. No. 12/260,775, issued on Sep. 9, 2011, 2 pages.

(Continued)

*Primary Examiner* — Thomas Mullen
(74) *Attorney, Agent, or Firm* — Hanley, Flight & Zimmerman, LLC

(57) ABSTRACT

Methods and apparatus to detect carrying of a portable audience measurement device are disclosed herein. An example portable audience measurement device includes a media detector carried by a housing to collect media exposure data; a distance comparator to compare a first distance to an object at a first time and a second distance to the object at a second time; and a compliance detector to validate the media exposure data based on the comparison of the distance comparator.

20 Claims, 6 Drawing Sheets

U.S. PATENT DOCUMENTS

| | | | |
|---|---|---|---|
| 2005/0272017 | A1 | 12/2005 | Neuhauser et al. |
| 2005/0272018 | A1 | 12/2005 | Crystal et al. |
| 2005/0272019 | A1 | 12/2005 | Crystal et al. |
| 2005/0273802 | A1 | 12/2005 | Crystal et al. |
| 2006/0003732 | A1 | 1/2006 | Neuhauser et al. |
| 2006/0028953 | A1 | 2/2006 | Jensen et al. |
| 2006/0168613 | A1 | 7/2006 | Wood et al. |
| 2007/0294705 | A1 | 12/2007 | Gopalakrishnan et al. |
| 2007/0294706 | A1 | 12/2007 | Neuhauser et al. |
| 2008/0001704 | A1 | 1/2008 | Roston |
| 2008/0010110 | A1 | 1/2008 | Neuhauser et al. |
| 2008/0015820 | A1 | 1/2008 | Kolessar et al. |
| 2008/0086533 | A1 | 4/2008 | Neuhauser et al. |
| 2008/0091087 | A1 | 4/2008 | Neuhauser et al. |
| 2008/0091451 | A1 | 4/2008 | Crystal |
| 2008/0091762 | A1 | 4/2008 | Neuhauser et al. |
| 2008/0148309 | A1 | 6/2008 | Wilcox et al. |
| 2009/0026358 | A1 | 1/2009 | Kassamakov et al. |
| 2010/0077420 | A1 | 3/2010 | Nielsen et al. |
| 2010/0102981 | A1 | 4/2010 | Nielsen et al. |

OTHER PUBLICATIONS

The United States Patent and Trademark Office, Notice of Allowance and Fee(s) Due, for corresponding U.S. Appl. No. 12/260,775, mailed on Jun. 30, 2011, 7 pages.

The United States Patent and Trademark Office, Non-Final Rejection, for corresponding U.S. Appl. No. 12/260,775, issued on Feb. 3, 2011, 10 pages.

The United States Patent and Trademark Office, Non-Final Office Action, in connection with U.S. Appl. No. 12/234,458, issued on Jun. 24, 2011, 22 pages.

The United States Patent and Trademark Office, Final Office Action issued in connection with U.S. Appl. No. 12/234,458 on Dec. 16, 2011 (21 pages).

METHODS AND APPARATUS TO DETECT CARRYING OF A PORTABLE AUDIENCE MEASUREMENT DEVICE

RELATED APPLICATION

This patent arises from a continuation of U.S. patent application Ser. No. 12/260,775, filed on Oct. 29, 2008, now U.S. Pat. No. 8,040,237, which is hereby incorporated by reference herein in its entirety.

FIELD OF THE DISCLOSURE

The present disclosure relates generally to audience measurement and, more particularly, to methods and apparatus to detect carrying of a portable audience measurement device.

BACKGROUND

Media-centric companies are often interested in tracking the number of times that audience members are exposed to media compositions (e.g., television programs, motion pictures, internet videos, radio programs, etc.). To track such exposures, companies often generate audio and/or video signatures (e.g., a representation of some, preferably unique, portion of the media composition or the signal used to transport the media composition) of media compositions that can be used to determine when those media compositions are presented to audience members. The media compositions may be identified by comparing the signatures to a database of reference signatures. Additionally or alternatively, companies transmit identification codes (e.g., watermarks) with media compositions to monitor presentations of those media compositions to audience members by comparing identification codes retrieved from media compositions presented to audience members with reference identification codes stored in a reference database. Like the reference signatures, the reference codes are stored in association with information descriptive of the corresponding media compositions to enable identification of the media compositions.

Audience measurement companies often enlist a plurality of panelists to cooperate in an audience measurement study for a length of time. For example, a panelist may be issued a portable metering device capable of collecting media exposure information indicative of the media to which the panelist is exposed. In such instances, the panelist agrees to carry the portable meter on their person at all times so that the portable meter is exposed to all of the media seen or heard by the panelist.

DETAILED DESCRIPTION

Figure 1:
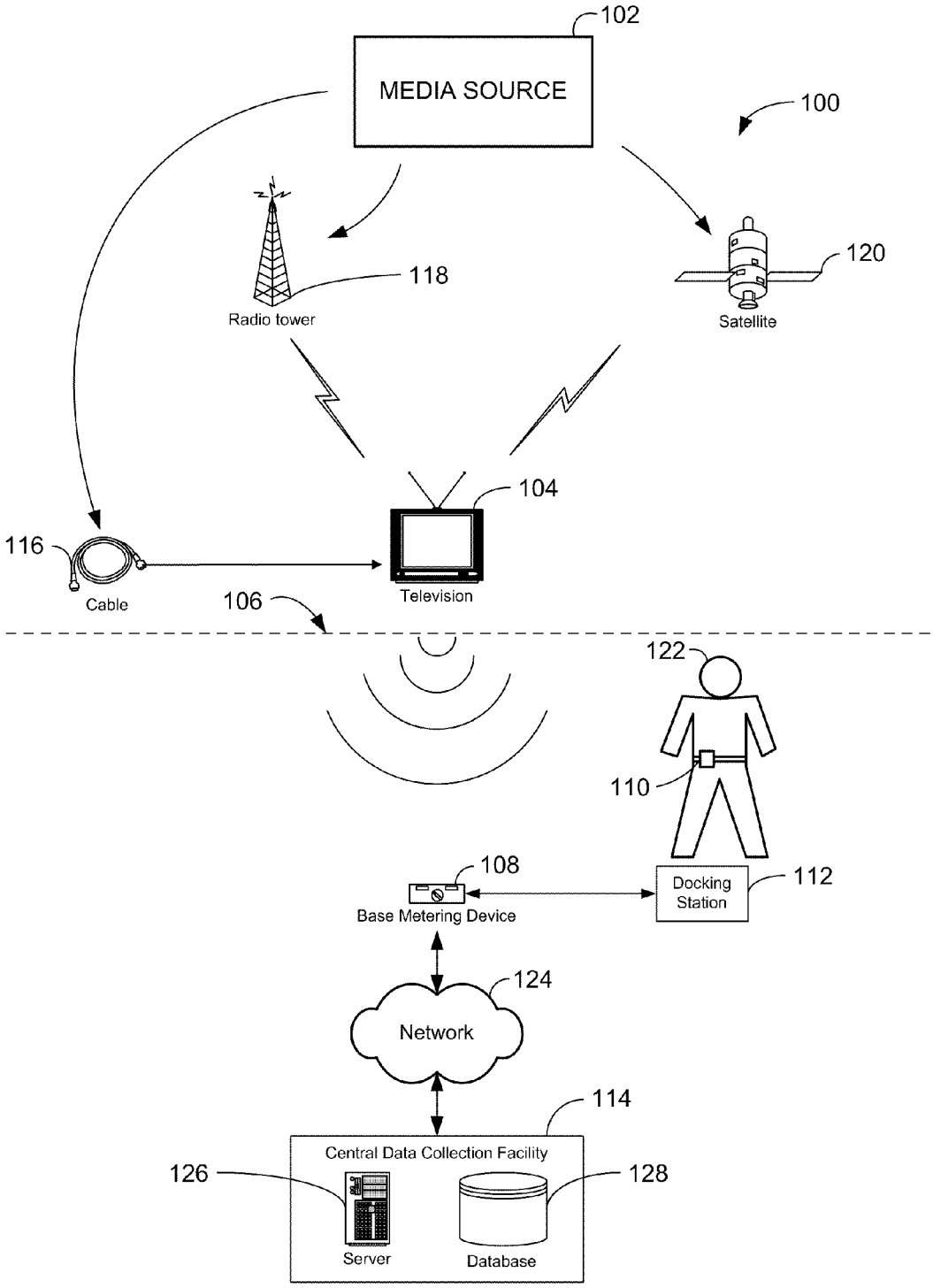
FIG. 1 is a block diagram of an example media exposure measurement system.

Although the following discloses example methods, apparatus, systems, and articles of manufacture including, among other components, firmware and/or software executed on hardware, it should be noted that such methods, apparatus, systems, and articles of manufacture are merely illustrative and should not be considered as limiting. For example, it is contemplated that any or all of these firmware, hardware, and/or software components could be embodied exclusively in hardware, exclusively in software, exclusively in firmware, or in any combination of hardware, software, and/or firmware. Accordingly, while the following describes example methods, apparatus, systems, and/or articles of manufacture, the examples provided are not the only way(s) to implement such methods, apparatus, systems, and/or articles of manufacture.

The example methods, apparatus, systems, and articles of manufacture described herein can be used to detect a status of a portable device such as, for example, a portable media measurement device. To collect media exposure information, such a portable meter is configured to generate, detect, decode, and/or, more generally, collect media identifying data (e.g., audio codes, video codes, audio signatures, video signatures, etc.) associated with media presentations to which the portable meter is exposed. If the portable meter is proximate a person at the time of exposure, it can be assumed that the person is also exposed to the media presentation. Thus, media measurement entities request participants in audience measurement panels to carry portable meters on their person.

The data reflecting media exposure of the panel participants is collected and used to statistically determine the size and/or demographics of audiences exposed to media presentations. The process of enlisting and retaining the panel participants ("panelists") can be a difficult and costly aspect of the audience measurement process. For example, panelists must be carefully selected and screened for particular demographic characteristics so that the panel is representative of the population(s) of interest. In addition, the panelists selected must be diligent about wearing the portable meters so that the audience measurement data accurately reflects their media habits. Thus, it is advantageous to additionally collect panelist compliance information indicative of whether panelists are properly carrying or failing to carry the portable meters.

The example methods, apparatus, systems, and articles of manufacture described herein determine whether a panelist is carrying a portable meter by detecting a first distance between the portable meter and an object (e.g., a body of a panelist or clothes on the panelist's body) at a first time, detecting a second distance between the portable meter and the object at a second time, and comparing the first and second distances. A change in distance between the portable meter and the object (e.g., a difference between the first and second distances) indicates that the portable meter is being worn by the panelist. Moreover, the time between detections of a change in distance can be used to determine a likelihood that the panelist is or was wearing the portable meter. To gather such status information, one or more sensors are disposed on the portable meter and/or on an attachment mechanism coupled to the portable meter used to attach the portable meter to the panelist (e.g., on an article of clothing such as a belt). In some example implementations, one or more infrared (IR) sensors are positioned on the back of the portable meter to take a reading in a direction pointing away from the back of the portable meter (e.g., toward the person carrying the portable meter). Additionally, the reading can be timestamped and conveyed to a processing unit for analysis (e.g., a comparison to a previous reading). The gathered status information can be used (e.g., by a server at a central facility or by processing components in the portable meter) to calculate a likelihood that the corresponding panelist is carrying the portable meter and/or to determine whether media exposure information collected by the meter should be credited to the panelist (e.g., counted as an instance of the panelist being exposed to the corresponding media content). If the panelist is not carrying the meter (e.g., the meter is left somewhere (e.g., on a table)), the exposure data collected by the meter at those times may not be reflective of an audience member exposure and, thus, the exposure should not be credited.

In the example of FIG. 1, an example media presentation system 100 including a media source 102 and a media presentation device 104 is metered using an example media measurement system 106. The measurement system 106 includes a base metering device 108, a portable metering device 110, a docking station 112, and a central facility 114. The media presentation device 104 is configured to receive media from the media source 102 via any of a plurality of transmission systems including, for example, a cable service provider 116, a radio frequency (RF) service provider 118, a satellite service provider 120, an Internet service provider (ISP) (not shown), or via any other analog and/or digital broadcast network, multicast network, and/or unicast network. Further, although the example media presentation device 104 of FIG. 1 is shown as a television, the example media measurement system 106 is capable of collecting information from any type of media presentation device including, for example, a personal computer, a laptop computer, a radio, a cinematic projector, an MP3 player, or any other audio and/or video presentation device or system.

The base metering device 108 of the illustrated example is configured as a primarily stationary device disposed on or near the media presentation device 104 and may be adapted to perform one or more of a plurality of metering methods (e.g., channel detection, collecting signatures and/or codes, etc.) to collect data concerning the media exposure of a panelist 122. Depending on the type(s) of metering that the base metering device 108 is adapted to perform, the base metering device 108 may be physically coupled to the presentation device 104 or may instead be configured to capture signals emitted externally by the presentation device 104 such that direct physical coupling to the presentation device 104 is not required. Preferably, a base metering device 108 is provided for each media presentation device disposed in a household, such that the base metering devices 108 may be adapted to capture data regarding all in-home media exposure for a group of household members.

Similarly, the portable metering device 110 is configured to perform one or more of a plurality of metering methods (e.g., collecting signatures and/or codes) to collect data concerning the media exposure of the panelist 122 carrying the device 110. In the illustrated example, the portable meter 110 is a portable electronic device such as, but not limited to, a portable (e.g., cellular) telephone, a personal digital assistant (PDA), and/or a handheld computer having the media measurement capabilities described herein integrated with other functionality (e.g., cellular telephone service, operating system platforms, email capabilities, etc.). Alternatively, the portable meter 110 may be dedicated to the media measurements described herein without including functionality that is unrelated to audience measurement. Because the portable meter 110 is assigned to a specific individual for whom demographic data has been obtained, the data it collects can be associated with a specific demographic population. To facilitate such association, the collected data is preferably associated with an identification that is unique to the portable meter 110 and/or the audience member to which the meter 110 is assigned.

The portable meter 110 of the illustrated example is capable of measuring media exposure that occurs both inside and outside a home. For example, the portable meter 110 is capable of detecting media to which the panelist 122 is exposed in places such as airports, shopping centers, retail establishments, restaurants, bars, sporting venues, automobiles, at a place of employment, movie theaters, etc. To gather such information, the panelist simply wears the portable meter 110 on his or her person (preferably at all times). As described in greater detail below in connection with FIGS. 3, 4A, and 4B, the portable meter 110 of FIG. 1 is configured to implement the example methods, apparatus, systems, and/or articles of manufacture described herein to collect information indicative of whether or not the panelist is carrying the portable meter 110.

In the example of FIG. 1, the base metering device 108 and the portable meter 110 are adapted to communicate with the remotely located central data collection facility 114 via a network 124. The network 124 may be implemented using any type of public or private network such as, but not limited to, the Internet, a telephone network, a local area network (LAN), a cable network, and/or a wireless network. To enable communication via the network 124, the base metering device 108 includes a communication interface that enables connection to an Ethernet, a digital subscriber line (DSL), a telephone line, a coaxial cable, or any wireless connection, etc. Likewise, the portable meter 110 includes an interface to enable communication by the portable metering device 110 via the network 124. In the illustrated example, either or both of the base metering device 108 and the portable metering device 110 are adapted to send collected media exposure data to the central data collection facility 114. Further, in the event that only one of the base metering device 108 and the portable metering device 110 is capable of transmitting data to the central data collection facility 114, the base and portable metering devices 108, 110 are adapted to communicate data to each other to provide a means by which collected data from all metering devices can be transmitted to the central data collection facility 114. The example central data collection facility 114 of FIG. 1 includes a server 126 and a database 128 to process and/or store data received from the base metering device 108, the portable metering device 110, and/or other metering device(s) (not shown) used to measure other panelists. Of course, multiple servers and/or databases may be employed.

The example portable meter 110 of FIG. 1 communicates via the network 124 using the docking station 112. The docking station 112 has a cradle in which the portable metering device 110 is deposited to enable transfer of data via the network 124 and to enable a battery (not shown) disposed in the portable metering device 110 to be recharged. The docking station 112 is operatively coupled to the network 124 via, for example, an Ethernet connection, a digital subscriber line (DSL), a telephone line, a coaxial cable, etc. Additionally or alternatively, when the portable meter 110 is implemented as a cellular telephone, a PDA, or other similar communication devices, the portable meter 110 may be configured to utilize the communication abilities of the associated device (e.g., a cellular telephone communication module) to transmit data to the central facility.

Figure 2:
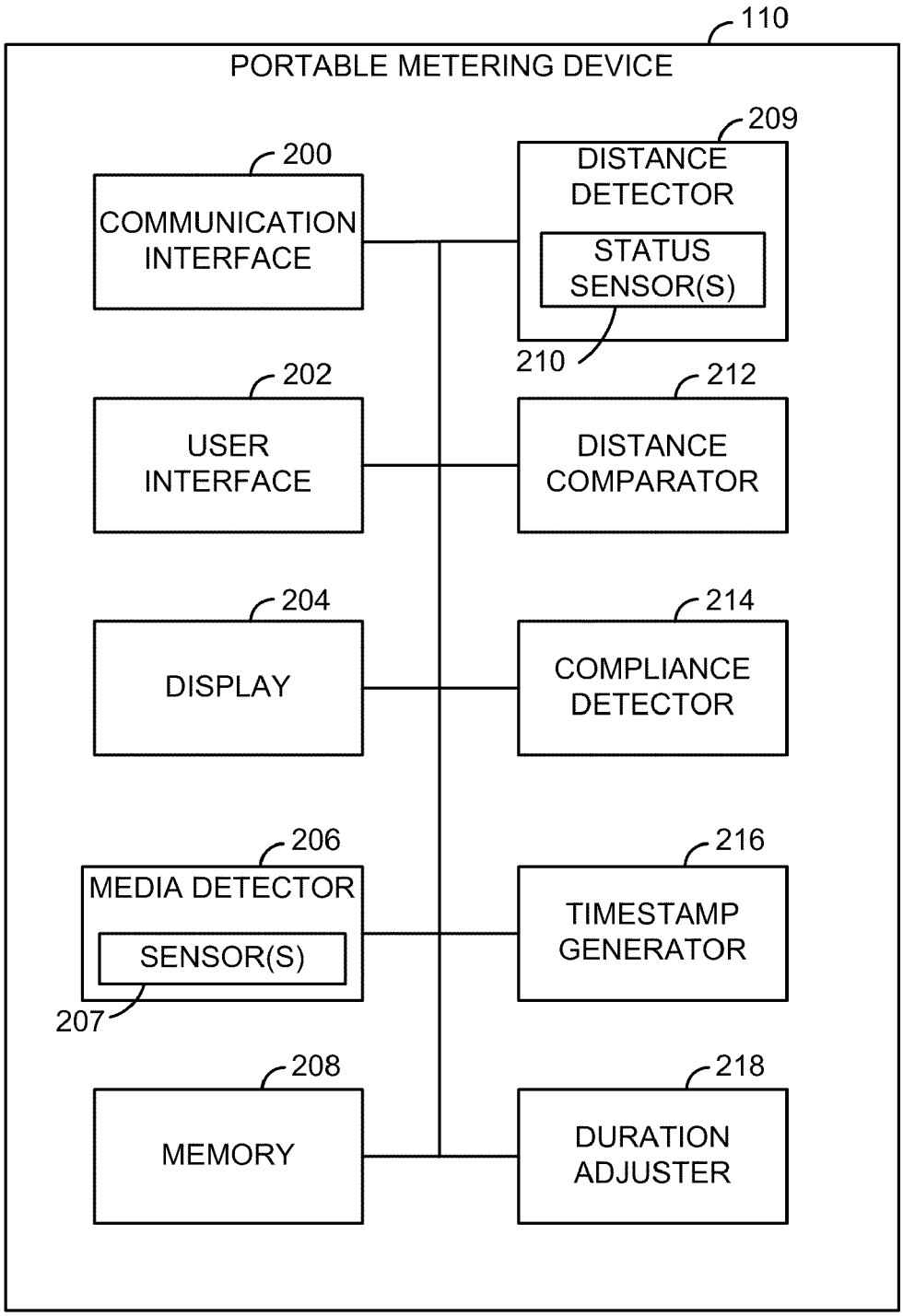
FIG. 2 is a block diagram of an example apparatus that may be used to implement the example portable metering device of FIG. 1.

FIG. 2 is a block diagram of an example apparatus that may be used to implement the example portable meter 110 of FIG. 1. In the illustrated example of FIG. 2, the example portable meter 110 includes a communication interface 200, a user interface 202, a display 204, a media detector 206, memory 208, a distance detector 209, a distance comparator 212, a compliance detector 214, a timestamp generator 216, and a duration adjuster 218. While an example manner of implementing the portable meter 110 of FIG. 1 has been illustrated in FIG. 2, one or more of the elements, processes and/or devices illustrated in FIG. 2 may be combined, divided, rearranged, omitted, eliminated and/or implemented in any other way. Further, the example communication interface 200, the example user interface 202, the example display 204, the example media detector 206, the example memory 208, the example distance detector 209, the example distance comparator 212, the example compliance detector 214, the example timestamp generator 216, the example duration adjuster 218, and/or, more generally, the example portable meter 110 of FIG. 2 may be implemented by hardware, software, firmware and/or any combination of hardware, software and/or firmware. Thus, for example, any of the example communication interface 200, the example user interface 202, the example display 204, the example media detector 206, the example memory 208, the example distance detector 209, the example distance comparator 212, the example compliance detector 214, the example timestamp generator 216, the example duration adjuster 218, and/or, more generally, the example portable meter 110 of FIG. 2 could be implemented by one or more circuit(s), programmable processor(s), application specific integrated circuit(s) (ASIC(s)), programmable logic device(s) (PLD(s)) and/or field programmable logic device(s) (FPLD(s)), etc. When any of the appended claims are read to cover a purely software and/or firmware implementation, at least one of the example communication interface 200, the example user interface 202, the example media detector 206, the example distance detector 209, the example distance comparator 212, the example compliance detector 214, the example timestamp generator 216, the example duration adjuster 218, and/or, more generally, the example portable meter 110 of FIG. 2 are hereby expressly defined to include a tangible, computer-readable medium such as a memory, DVD, CD, etc. storing the software and/or firmware. Further still, the example portable meter 110 of FIG. 2 may include one or more elements, processes and/or devices in addition to, or instead of, those illustrated in FIG. 2, and/or may include more than one of any or all of the illustrated elements, processes and devices.

The communication interface 200 of the illustrated example enables the portable meter 110 to convey and/or receive data to and/or from the other components of the media exposure measurement system 106 (FIG. 1). For example, the communication interface 200 enables communication between the portable meter 110 and the central facility 114, between the portable meter 110 and the base metering device 108, and/or between the portable meter 110 and the docking station 112. The communication interface 200 of FIG. 2 is implemented by, for example, an Ethernet card, a digital subscriber line, a coaxial cable, and/or any wireless connection.

The user interface 202 of the illustrated example is used by the panelist 122 (FIG. 1) to enter data (e.g., identity information associated with the panelist 122 and/or demographic data such as age, race, sex, household income, etc.) and/or commands into the portable meter 110. Entered data and/or commands are stored (e.g., in the memory (e.g., memory 524 and/or memory 525) of the example processor system 510 of FIG. 5) and may be subsequently transmitted to the base metering device 108 and/or the central facility 114. The user interface 202 of FIG. 2 is implemented by, for example, a keyboard, a mouse, a track pad, a track ball, and/or a voice recognition system.

The example display 204 of FIG. 2 is implemented using, for example, a light emitting diode (LED) display, a liquid crystal display (LCD), and/or any other suitable display configured to present visual information. For example, the display 204 conveys information associated with a log-in status of the panelist 122, media content being identified by the portable meter 110, status information (e.g., on/off information, whether an indication of the portable meter being worn by the panelist has been received in a predefined period of time), etc. Although the display 204 and the user interface 202 are shown as separate components in the example of FIG. 2, the display 204 and the user interface 202 may instead be integrated into a single component such as, for example, a touch-sensitive screen configured to enable interaction between the panelist 122 and the portable meter 110.

The example media detector 206 of FIG. 2 includes one or more sensors 207 (e.g., optical and/or audio sensors) configured to detect particular aspects of media to which the portable meter 110 is exposed. For example, the media detector 206 may be capable of collecting signatures and/or detecting codes (e.g., watermarks) of media content to which it is exposed by using an audio sensor such as a microphone to collect audio signals emitted by an information presentation device and processing the same to extract the codes and/or generate the signatures. Data gathered by the media detector 206 is stored in the memory 208 and later used to identify the media to which the portable meter 110 is being exposed. The precise methods to collect media identifying information are irrelevant, as any methodology to collect audience measurement data may be employed without departing from the scope or spirit of this disclosure.

The example distance detector 209 of FIG. 2 collects information using one or more status sensor(s) 210 to enable a determination of whether or not the panelist 122 is carrying the portable meter 110. For example, the distance detector, via the status sensor(s) 210, detects a distance between the portable meter 110 and an object nearest the portable meter 110 in a direction pointing away from the status sensor(s) 210. Preferably, the status sensor(s) 210 are directed toward the body of the wearer of the portable meter 110. However, some of all of the status sensor(s) 210 may be pointed away from the wearer's body. In the illustrated example, the status sensor(s) 210 are periodically or aperiodically activated to take a distance reading after the expiration of a period of time such as, for example, five or ten seconds.

The distance reading is conveyed to the distance comparator 212, which stores the distance readings taken at different times to gather information regarding compliance-related activities (e.g., the carrying of the portable meter 110 on a belt, purse strap, or other piece of clothing, or in a purse or any other type of bag being carried by or attached to the panelist 122). When the distance detector 209 includes a single status sensor 210, the example distance comparator 212 computes a difference (if any) between a current distance reading (e.g., the most recently received input) taken by the single sensor 210 and the immediately prior (in time) distance reading taken by the single sensor 210. When the distance detector 209 includes more than one status sensor 210 (e.g., as illustrated in the example portable meter 110 of FIG. 3), the example distance comparator 212 computes a first difference (if any) between a first current distance reading taken by a first one of the sensors 210 and the immediately prior (in time) distance reading taken by that same first sensor 210. In such instances, the example distance comparator 212 also computes a second difference (if any) between a second current distance readings taken by a second one of the sensors 210 and the immediately prior (in time) distance reading taken by that same second sensor 210. The example distance comparator 212 performs such a comparison for any additional sensors 210.

In addition to comparing current and previous distance readings of the sensor(s) 210, the example distance comparator 212 may also generate a binary value indicative of whether any difference resulted from the comparison(s). In the illustrated example, the compliance detector 214 applies certain tolerance(s) in determining compliance. For example, a difference between two distance readings taken at two different times by the same sensor may not be interpreted as an indication of the panelist 122 carrying the portable meter 110 unless the difference meets or exceeds a threshold. Thus, in determining the likelihood that the panelist 122 is carrying the portable meter 110, the compliance detector 214 may analyze the magnitude(s) of detected distance difference(s). For example, when a comparison of current and previous distance readings results in a non-zero value of, for example, 0.5 mm or −0.5 mm, the example distance comparator 212 generates a true (e.g., logic '1') bit. On the other hand, when a comparison of current and previous distance readings results in a zero value or a value below a threshold (e.g., 0.01 mm) that is interpreted as a zero value, the example distance comparator 212 generates a false (e.g., logic '0') bit. In some examples, where the portable meter 110 includes more than one status sensor, different tolerances may be assigned to each sensor for the interpretation of a distance difference as a zero value. For example, a first one of the status sensors 210 disposed on the portable meter 110 at a first position may be assigned a first tolerance according to the expected distance between the first one of the sensors 210 and the panelist 122 while the portable meter 110 is being carried. A second one of the status sensors 210 disposed on the portable meter 110 at a second position may be assigned a second, different tolerance according to the expected distance between the second one of the sensors 210 and the panelist 122 while the portable meter 110 is being carried.

Further, the distance comparator 212 tracks the magnitude and polarity (e.g., positive or negative) of any computed distance difference. For example, when the current distance reading taken by one of the sensor(s) 210 is less than the immediately prior distance reading taken by that sensor, the distance comparator 212 assigns the resulting difference a negative value. In such instances, when the current distance reading taken by one of the sensor(s) 210 is greater than the immediately prior distance readings taken by that sensor, the distance comparator 212 assigns the resulting difference a positive value. In other examples, the opposite polarities may be assigned to the distance differences, so long as the configuration is known to the other components of the portable meter 110, such as the compliance detector 214.

The compliance detector 214 receives the results of the comparison(s) (e.g., magnitudes of the computed differences between distance readings, polarities of the computed differences, and the binary value indicative of whether any difference resulted from the comparison(s)) performed by the distance comparator 212 and determines a likelihood that the panelist 122 is carrying the portable meter 110 and, thus, whether the audience measurement data collected by the media detector 206 of the portable meter 110 should be credited as valid. Generally, differences between the distance readings of the same sensor at different times indicate that the portable meter 110 has changed its location relative to the nearest object.

Additionally or alternatively, the compliance detector 214 may analyze timestamp(s) corresponding to the distance reading(s) to detect, for example, an extended period of time between occurrences of a change in distance detected by the sensors 210. Additionally or alternatively, the compliance detector 214 may consider the polarity of the detected distance differences. For example, a positive distance difference (e.g., when the current reading is greater than the immediately prior (in time) reading) may indicate that the portable meter 110 was removed from an object, such as a belt on the person of the panelist 122. In such instances, a negative distance difference (e.g., when the current reading is less than the immediately prior (in time) reading) may indicate that the portable meter 110 was attached to an object, such as the fore mentioned belt. Additionally or alternatively, the compliance detector 214 may count a number of detected distance differences occurring over a period of time (e.g., over ten minutes). The compliance detector 214 may include this count (e.g., a frequency) in the likelihood calculation.

As described above, when the portable meter 110 includes more than one status sensor 210, the distance comparator 212 computes distance differences for each sensor 210, and the compliance detector 214 receives the distance comparison results for each of the sensors 210. In such instances, the compliance detector 214 may interpret any difference in the readings (e.g., a detected difference at only one of the sensors 210) as a credible indication of compliance. Alternatively, the compliance detector 214 may require more than a threshold amount (e.g., a majority) of the sensors 210 to detect a distance variation over a given time period to conclude that the panelist 122 is currently carrying the portable meter 110. The compliance detector 214 may implement additional or alternative methods of interpreting the results received from the distance comparator 212. As described below in connection with FIGS. 3, 4A, and 4B, the compliance detector 214 may compute a likelihood that the panelist 122 is carrying the portable meter 110 based on data collected by one or more of the plurality of sensors 210. As shown and described in connection with FIG. 4B, the likelihood may be calculated based on individual sensors and/or may be a cumulative likelihood derived from (e.g., averaged) a plurality of likelihoods calculated in association with individual ones of the sensors.

Further, the calculations performed by the compliance detector 214 described herein may additionally or alternatively be performed at the central facility 114 (e.g., by the analysis server 126). In such instances, the central facility 114 receives the results from the distance comparator 212 via the communication interface 200. In such examples, the compliance detector 214 is eliminated from the portable meter 110 and located at the central facility 114. In other examples, some of the functions of the compliance detector 214 described herein may be performed at the portable meter 110, while the remainder of the functions are performed at the central facility 114. In such instances, both the portable meter 110 and the central facility 114 include a compliance detector 214 and the functions performed by each of the compliance detectors 214 are known to the other.

The status sensor(s) 210 are implemented using, for example, IR sensor(s), optical sensor(s), or any other type of sensor capable of detecting a distance between two objects.

The status sensor(s) 210 of the example of FIG. 2 are described in greater detail below in connection with FIGS. 3, 4A, and 4B.

In the illustrated example, the timestamp generator 216 is configured to generate timestamps indicating the date and/or time at which, for example, (1) the distance detector 209 generates a distance reading via the status sensor(s) 210, (2) the media detector 206 detects exposure to media, (3) the panelist 122 enters data and/or a command into the portable meter 110, (4) the portable meter 110 communicates with the base metering device 108 and/or the central facility 114, (5) the distance comparator 212 performs a calculation, and/or (6) any other notable event. Additionally or alternatively, the timestamp generator 216 may generate timestamp(s) representative of a duration during which a status (e.g., a distance between the portable meter 110 and the nearest object) of the portable meter 110 remains unchanged.

To avoid an excessive amount of readings (e.g., to reduce the number of times the status sensor(s) 210 are activated during periods of panelist inactivity (e.g., during night hours when the panelist 122 is likely to be sleeping and/or other time periods when the portable meter 110 is not being carried)) and, thus, to save power, the portable meter 110 includes the duration adjuster 218. In the illustrated example, the status sensor(s) 210 take readings at adjustable intervals. The duration adjuster 218 stores a default duration of, for example, ten seconds and the sensor(s) 210 initially take readings at this default interval rate. The duration adjuster 218 adjusts the duration (e.g., by increasing the duration from the default duration) based on the length of time expired since the last time a difference in distances between the portable meter 110 and the nearest object was detected. In particular, the longer the status sensor(s) 210 go without detecting a distance variation, the more the duration adjuster 218 increases the duration (e.g., up to some maximum value such as once per fifteen minutes). On the other hand, once any of the status sensor(s) 210 detects a distance change, the duration adjuster 218 resets the duration to the default value.

Figure 3:
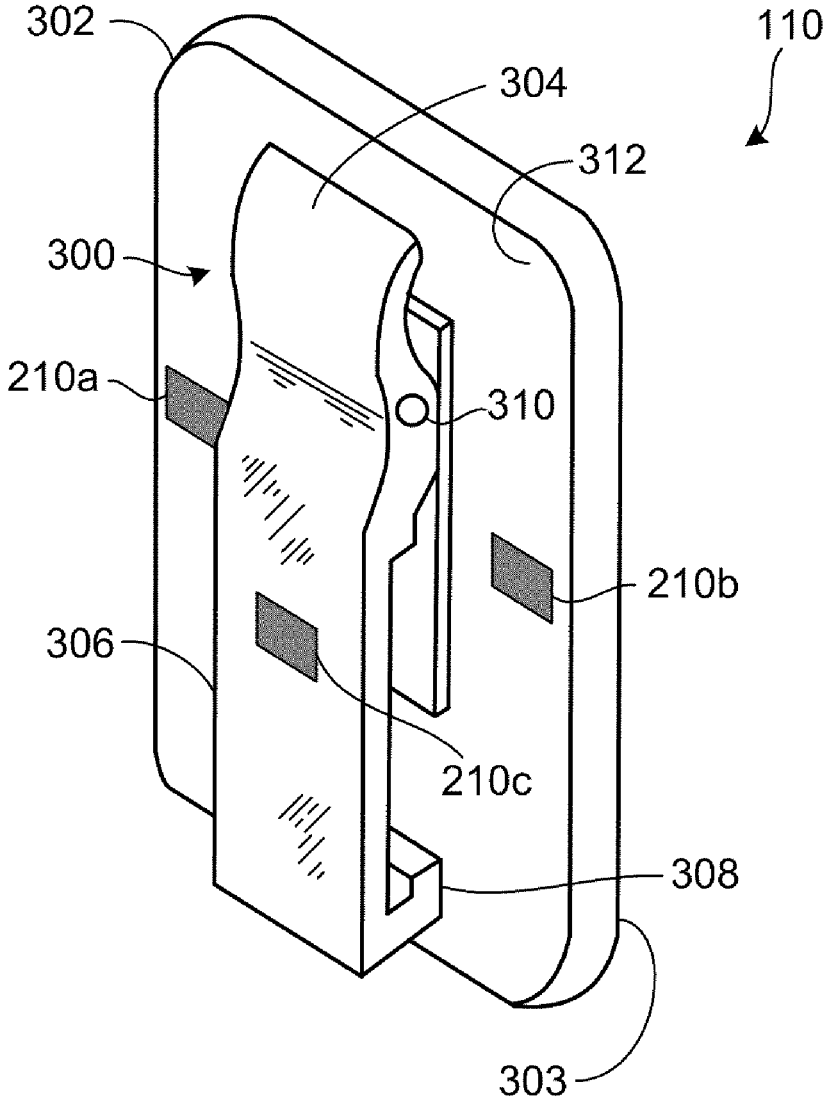
FIG. 3 is an illustration of an example implementation of the example portable meter of FIG. 2.

FIG. 3 is an illustration of an example implementation of the example portable meter 110 of FIG. 2. In the illustrated example, the portable meter 110 includes an attachment mechanism 300, which is shown as a clip in FIG. 3. The clip 300 is mounted to a body 302 of the portable meter 110, which houses the electronic components described above in connection with FIG. 2 (e.g., the communication interface 200, the user interface 202, the display 204, the media detector 206, the memory 208, the distance detector 209, the status sensor (s) 210, the distance comparator 212, the compliance detector 214, the timestamp generator 216, and/or the duration adjuster 218). In the illustrated example, the media sensors 207 are positioned on a front side 303 of the body 302. In other examples, the media sensors 207 may be positioned in other locations to enable the collection of media information as described above.

The clip 300 may be mounted to the body 302 in any of a plurality of manners, such as via an adhesive, by a pin, or by integrally forming the clip 300 as part of the body 302. The clip 300 includes an actuator 304 and an elongated arm 306 having a hook 308 extending therefrom. To open the clip 300, the panelist 122 applies a force to the actuator 304 toward the body 302. In response, the elongated arm 306 extends away from the body 302 about an axis defined by a pin 310 on which a spring (not shown) is seated, thereby creating space between the hook 308 and the body 302. An article of clothing, such as a belt, can then be inserted between the elongated arm 306 and the body 302. When the belt has been inserted, the panelist 122 releases the actuator 304, allowing the spring to force the elongated arm 306 back toward the body 302. The hook 308 then retains the belt within the clip 300.

As a result, when the portable meter 110 is attached to a belt or an article of clothing, a back side 312 of the body 302 faces the panelist. Accordingly, one or more of the status sensor(s) 210 (FIG. 2) is disposed on the back side 312 of the body 302 to detect a distance between the portable meter 110 and the panelist and/or changes in the distance between the portable meter 110 and the panelist. In the illustrated example of FIG. 3, a first sensor 210*a* and a second sensor 210*b* are disposed on the back side 312 of the body 302, next to the elongated arm 306. Further, in the illustrated example of FIG. 3, a third sensor 210*c* is disposed on the elongated arm 306. The sensors 210*a-c* face a direction pointing away from the back side 312 of the body 302 (e.g., toward the body of the person carrying the portable meter 110). In other examples, the sensors 210*a-c* may be positioned at one or more additional and/or alternative location(s) capable of detecting a distance between the portable meter 110 and another object. In the illustrated example, the sensors 210*a*, 210*b*, and/or 210*c* are implemented using infrared sensors, each of which comprises an emitter and a detector. The emitter of an infrared sensor emits an infrared signal that is reflected off an object and returned to the infrared sensor where it is detected by the detector. The characteristic(s) of the infrared signal upon its return to the sensor (e.g., the time it takes to travel from the emitter back to the detector of the sensor) can be used to calculate a distance between the infrared sensor and the object off which the infrared signal was reflected. In particular, the example distance detector 209 (FIG. 2) uses the detected characteristics(s) from the infrared sensor(s) 210*a*, 210*b*, and/or 210*c* to generate a corresponding electrical signal representing the calculated distance. Other types of sensors capable of converting a distance between two objects into an electrical output signal can additionally or alternatively be used.

While the example portable meter 110 of FIG. 3 includes three sensors 210*a-c*, only one of the sensors 210*a*, 210*b*, or 210*c* or a combination of the three sensors 210*a-c* (e.g., the first sensor 210*a* and the second sensor 210*b*, the first sensor 210*a* and the third sensor 210*c*, the second sensor 210*b* and the third sensor 210*c*, all three sensors 210*a-c*) can be active at any given time. In the illustrated example, when a change in the distance readings described above has not been detected for a threshold amount of time (e.g., one hour), only one of the sensors 210*a-c* is used. In such instances, the sensor 210*a-c* being used may be changed periodically or aperiodically so that no single sensor is worn out substantially before the other sensor(s). The technique of activating only one (or a subset) of the sensors 210*a-c* and/or periodically or aperiodically cycling through which of the sensors 210*a-c* are active is referred to herein as a 'subset mode.' On the other hand, when a change in the distance readings described above has recently been detected (e.g., within the last hour), multiple sensors (e.g., all of the sensors 210*a-c*) are activated to improve the likelihood that changes in distance are accurately detected.

As described above in connection with FIG. 2, the signals generated by the distance detector 209 via the sensors 210*a-c* are conveyed to the distance comparator 212. In the illustrated example of FIG. 3, in which the portable meter 110 includes multiple sensors 210*a-c*, the distance comparator 212 respectively compares current distance readings (e.g., the most recently received input from the distance detector 209) taken from each of the sensors 210*a-c* with previous readings (e.g., input received from the distance detector 209 immediately prior to the current distance readings) taken by the same sensors 210*a-c*. In a given cycle, when all of the sensors 210*a-c* are active, the distance comparator 212 generates a first comparison result associated with the sensor labeled with reference numeral 210*a*, a second comparison result associated with the sensor labeled with reference numeral 210*b*, and a third comparison result associated with the sensor labeled with reference numeral 210*c*. Thus, each sensor 210*a-c* is individually capable of detecting a change in distance between the portable meter 110 and the panelist 122. In the illustrated example, each of the first, second, and third comparison results includes a magnitude of the difference(s) (if any) between current and previous readings associated with the corresponding sensor 210*a-c* and a binary value indicative of whether any difference was detected. As described above, the timestamp generator 216 generates a time stamp and associates the same with each of the comparison results.

The comparison result(s) of the distance comparator 212 and the associated timestamp(s) are conveyed directly or indirectly (e.g., via the memory 208) to the compliance detector 214 for analysis. The compliance detector 214 performs any of a plurality of different analyses to calculate a likelihood that the panelist 122 is carrying the portable meter 110. Factors to be considered in the likelihood calculation include, for example, magnitudes of distance differences, polarity (e.g., positive or negative) of distance differences, frequency of compliance indications, extended periods of time between compliance indications, etc. For example, when one of the comparison results received from the distance comparator 212 includes a distance difference of a large magnitude (e.g., greater than six inches), the compliance detector 214 of the illustrated example interprets such information as an indication that the portable meter 110 was either being attached to an object (e.g., a belt of the panelist 122) or removed therefrom. In such instances, the polarity of the distance difference received from the distance comparator 212 indicates whether the portable meter 110 was attached to the object or removed therefrom. In the illustrated example, when the polarity of the distance difference is positive, the compliance detector 214 determines that the portable meter 110 was likely removed from an object. On the other hand, in the illustrated example, when the polarity of the distance difference is negative, the compliance detector 214 determines that the portable meter 110 was likely attached to an object. In other instances, when the magnitude of the distance difference is small (e.g., two millimeters), the compliance detector 214 may not consider the polarity of the difference in the likelihood calculation.

In the illustrated example, in which the portable meter 110 includes multiple sensors 210*a-c*, the compliance detector 214 performs a likelihood calculation for each of the sensors 210*a-c* individually using the individual readings taken from each of the sensors 210*a-c*. In other words, the first comparison results (e.g., magnitudes of differences, polarities, timestamps, etc.) associated with the sensor labeled with reference numeral 210*a* received from the distance comparator 212 are used by the compliance detector 214 to calculate a likelihood of compliance according to that sensor 210*a*. Additionally, the second comparison results associated with the sensor labeled with reference numeral 210*b* received from the distance comparator 212 are used by the compliance detector 214 to calculate a likelihood of compliance according to that sensor 210*b*. Similar measurements and calculations are performed in association with the sensor labeled with reference numeral 210*c*. In the illustrated example of FIG. 3, the compliance detector 214 calculates the average of (1) the likelihood of compliance associated with sensor 210*a*, (2) the likelihood of compliance associated with sensor 210*b*, and (3) the likelihood of compliance associated with sensor 210*c* and stores the average as the cumulative likelihood that the panelist 122 is carrying the portable meter 110. If the cumulative likelihood meets or exceeds a threshold, the associated readings (e.g., any detected media or the lack thereof) are credited as valid. In other examples, the individual likelihoods associated with each sensor 210*a-c* may be separately compared to the threshold and the associated readings may be credited as valid if any of the likelihoods and/or a majority of the likelihoods meet or exceed the threshold.

In addition to, or instead of, the sensors 210*a-c* shown in the illustrated example of FIG. 3, the status of the portable meter 110 may be detected using alternative or additional types of sensor(s), placed in alternative or additional locations, and/or coupled to alternative or additional components of the portable meter 110 and/or the attachment mechanism 300. Further, the compliance determinations and/or calculations described above (e.g., the likelihood of compliance as generated by the compliance detector 214) may be additionally or alternatively performed at the central facility 114 (e.g., by the analysis server 126).

Figure 4A:
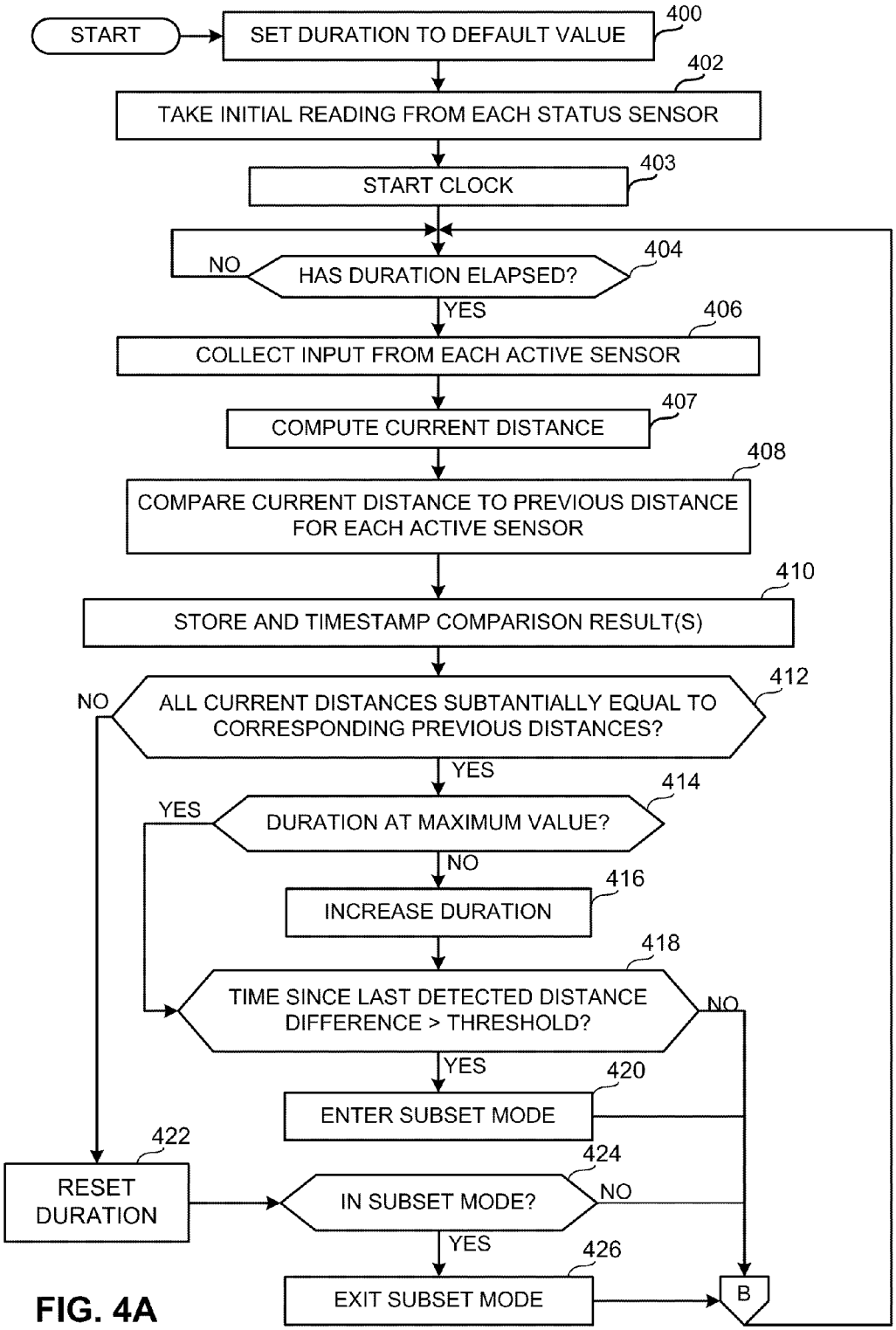
FIGS. 4A and 4B are a flow diagram representative of example machine readable instructions that may be executed to implement the example portable meter of FIG. 2 to collect media exposure information including a status of the example portable meter and to calculate a likelihood that a panelist is wearing the portable meter.
Figure 4B:
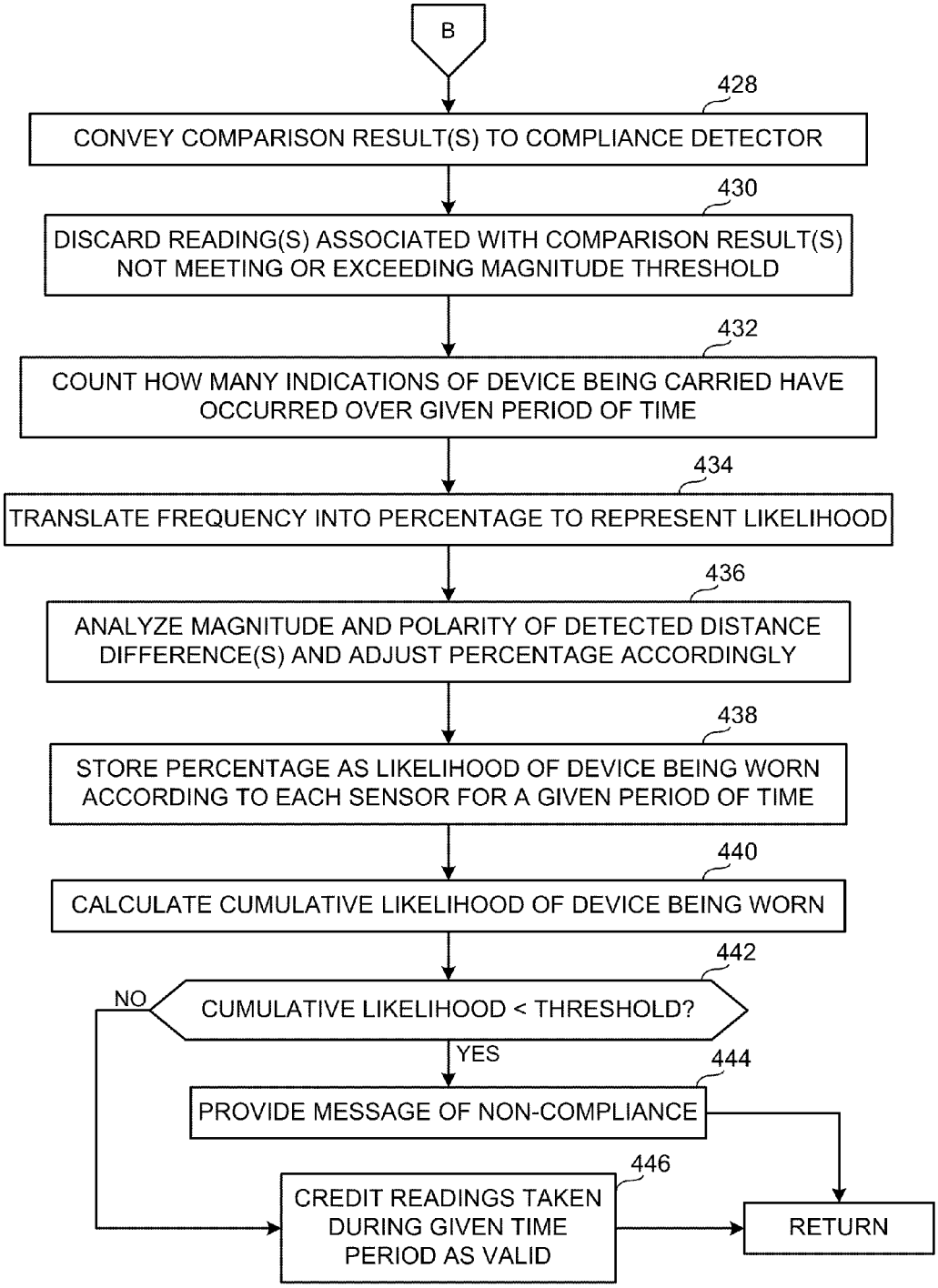

The flow diagrams depicted in FIGS. 4A and 4B are representative of machine readable instructions that can be executed to implement the example methods, apparatus, systems, and/or articles of manufacture described herein. In particular, FIGS. 4A and 4B depict a flow diagram representative of machine readable instructions that may be executed to implement the example portable meter 110 of FIGS. 1, 2, and 3 to collect compliance information and to calculate a likelihood that a panelist is wearing the portable meter 110. The example instructions of FIGS. 4A and/or 4B may be performed using a processor, a controller and/or any other suitable processing device. For example, the example instructions of FIGS. 4A and/or 4B may be implemented in coded instructions stored on a tangible medium such as a flash memory, a read-only memory (ROM) and/or random-access memory (RAM) associated with a processor (e.g., the example processor 512 discussed below in connection with FIG. 5). Alternatively, some or all of the example instructions of FIGS. 4A and/or 4B may be implemented using any combination(s) of application specific integrated circuit(s) (ASIC(s)), programmable logic device(s) (PLD(s)), field programmable logic device(s) (FPLD(s)), discrete logic, hardware, firmware, etc. Also, some or all of the example instructions of FIGS. 4A and/or 4B may be implemented manually or as any combination(s) of any of the foregoing techniques, for example, any combination of firmware, software, discrete logic and/or hardware. Further, although the example instructions of FIGS. 4A and 4B are described with reference to the flow diagrams of FIGS. 4A and 4B, other methods of implementing the instructions of FIGS. 4A and 4B may be employed. For example, the order of execution of the blocks may be changed, and/or some of the blocks described may be changed, eliminated, sub-divided, or combined. Additionally, any or all of the example instructions of FIGS. 4A and 4B may be performed sequentially and/or in parallel by, for example, separate processing threads, processors, devices, discrete logic, circuits, etc.

In FIG. 4A, the methodology for collecting the media exposure data is not shown. However, media exposure data is being constantly collected (if available) and time stamped in parallel with the execution of the instructions of FIG. 4A. Thus, for example, the media exposure data may be collected using any desired technique by a parallel thread or the like.

Turning to FIG. 4A, a duration defined to control periods of time at which the status sensors 210*a-c* (FIG. 3) take a reading is initially set to a default value by the duration adjuster 218 (FIG. 2) (block 400). In the illustrated example, the duration is a value stored by the duration adjuster 218 to define an interval (e.g., a period of time between a first and a second reading taken by one of the sensors 210*a-c*) at which the status sensors 210*a-c* take readings. As described in greater detail below, in the illustrated example, the duration is adjusted by the duration adjuster 218 based on, for example, when the last change in distance was detected. In other examples, the duration may be fixed.

The status sensors 210*a-c* then take an initial reading associated with the status of the portable meter 110 (block 402). For example, the initial input may be the first reading taken by the sensors 210*a-c* on a new device or the first reading taken by the sensors 210*a-c* after the device was turned off. In the illustrated example, readings are taken from each of the sensors 210*a-c* at substantially the same time. In other examples, readings may be taken on an alternating or rotating basis. As described above, the readings taken from sensors 210*a-c* (e.g., the first, second, and/or third sensor 210*a*, 210*b*, and/or 210*c*) and/or any other sensor capable of receiving data representing the status of the portable meter 110 include, for example, a distance between the portable meter 110 and an object near the portable meter (e.g., the body of the panelist 122 of FIG. 1). The sensors 210*a-c* may be implemented by infrared sensors (e.g., emitter/detector pairs) configured to emit infrared light and to receive the emitted infrared light after being reflected off the object. Characteristics of the reflected infrared light (e.g., travel time) are used by the distance detector 209 to determine, for example, a distance between the object and the corresponding one of the sensors 210*a-c*.

After each one of the status sensors 210*a-c* collects an initial reading, a clock is started (block 403). When a duration measured by the clock exceeds the duration set by the duration adjuster 218 (block 404), control proceeds to block 406, where the sensors 210*a-c* are again activated to collect data. A current distance is computed by the distance detector 209 based on data collected by each status sensor 210*a-c* (block 407). The computed distance(s) are conveyed to the distance comparator 212. The distance comparator 212 then compares the current distance measured by each active sensor 210*a-c* to the distance detected in the previous reading of that same sensor (e.g., the initial input or the last reading taken by the sensor) (block 408). Using these comparisons, the distance comparator 212 generates one or more outputs for each of the sensors 210*a-c* including, for example, a magnitude of distance differences (if any), a polarity of each distance difference, and/or a binary value indicating whether a distance difference was detected. In the illustrated example, the outputs or comparison results are timestamped by the timestamp generator 216 and stored in the memory 208 (block 410).

As described above, a determination that the current distance between the portable meter 110 and the object detected by the sensors 210*a-c* is substantially equal to the immediately prior (in time) distance detected by the sensors 210*a-c* suggests that the portable meter 110 is not currently being carried by the panelist 122. Therefore, if the comparison results stored in the memory 208 at block 410 in the example of FIG. 4A indicate that all current distances (e.g., as detected by each sensor 210*a-c* and/or as indicated by the binary value and/or the magnitude of the difference generated by the distance comparator 212) are substantially equal to the corresponding previous distances (block 412), the duration adjuster 218 increases the duration between sensor readings. However, the duration adjuster 218 first determines if a maximum duration value is currently assigned to the duration to avoid exceedingly long periods of time between sensor readings (block 414). Specifically, if the current duration is not at its maximum value (block 414), the duration adjuster 218 increases the duration by some predetermined value (e.g., 0.1 seconds) (block 416). Such an approach reduces the amount of sensor activation that is unlikely to yield useful results (e.g., during times at which the portable meter 110 is likely not being carried by the panelist 122). For example, when the panelist 122 goes to sleep at night and is not wearing the portable meter 110, the increased duration between readings caused by the fact that the readings are not changing results in less power being consumed by the device.

Additionally, as described above, when the sensor readings indicate that the portable meter 110 has not recently been carried by the panelist, the sensors 210*a-c* may enter a subset mode. The subset mode includes activating only a subset (e.g., one of three) of the sensors 210*a-c* to conserve power and to increase the functional lifetime of the sensors 210*a-c*. Additionally, the subset mode includes activating the subset of sensors 210*a-c* on a rotating, cyclical basis such that no one sensor becomes worn out faster than the other sensors. In the illustrated example of FIG. 4A, if the timestamps stored in the memory 208 indicate that the time since the last detected distance difference is greater than a threshold (block 418), the sensors 210*a-c* enter the subset mode (block 420).

Referring back to block 412, a determination that the current distance between the portable meter 110 and the object as detected by any one of the sensors 210*a-c* is not substantially equal to the immediately prior (in time) distance detected by the corresponding sensors 210*a-c* suggests that the portable meter 110 is currently being carried by the panelist 122. Therefore, if any of the comparison results stored in the memory 208 at block 410 in the example of FIG. 4A indicate that a current distance (e.g., as detected by any of the sensors 210*a-c*) is not substantially equal to the corresponding previous distance (e.g., as indicated by any of the binary values and/or the magnitudes of the differences generated by the distance comparator 212) (block 412), the duration adjuster 218 resets the duration to its default value so that the sensors 210*a-c* take readings at regular intervals (e.g., at times defined by the initially set default duration in the duration adjuster 218) (block 422). In the illustrated example of FIG. 4A, if the sensors 210*a-c* are in the subset mode described above (block 424), the sensors 210*a-c* are taken out of the subset mode by activating all of the sensors 210*a-c* (block 426).

Irrespective of whether control passes through block 426, control advances from block 424 to block 428 of FIG. 4B, where the comparison results generated by the distance comparator 212 are conveyed to the compliance detector 214. Although the compliance detector 214 is shown in FIG. 2 as part of the portable meter 110, it may alternatively be located in the central facility 114 (FIG. 1). For ease of discussion, the following assumes that compliance detector 214 is in the portable meter 110.

In general, the compliance detector 214 calculates a likelihood that the portable meter 110 was carried by the panelist 122 during a given period of time (e.g., the last ten, fifteen, or twenty minutes). To perform the likelihood calculation, the compliance detector 214 uses one or more of the characteristics/readings associated with the status sensors 210*a-c* and/or the comparison results generated by the distance comparator 212. As described above, a detected difference output by the distance comparator 212 is considered an indication of compliance if the magnitude of the detected difference exceeds the corresponding threshold. Thus, in the illustrated example, the compliance detector 214 compares the magnitude(s) of any differences generated by the distance comparator 212 to a threshold value (e.g., a value programmed into the compliance detector 214 according to expected differences that are substantial enough to indicate that the portable meter 110 is being carried by the panelist 122) and discards any differences not meeting or exceeding the threshold (block 430). As described above, different thresholds may be used with different sensors in such a comparison based on, for example, an expected distance difference between the portable meter 110 and the panelist 122 when the portable meter is being carried. For instance, the sensor 210*c* located on the elongated arm 306 in FIG. 3 may be assigned a lower tolerance by the compliance detector 214 than either of the other sensors 210*a* and 210*b* located on the body 302 of the portable meter 110. In other examples, differences in the distance readings having a magnitude not meeting or exceeding the corresponding threshold may be still considered and/or assigned a weight corresponding to the magnitude to be used in the likelihood calculation.

In the illustrated example, the compliance detector 214 then counts the number of times a distance difference (that was not discarded at block 430 because the difference did not meet the threshold) was detected over the period of time for which the likelihood is being calculated (block 432). In other words, the compliance detector 214 calculates a frequency of compliance indications for the given period of time. In the illustrated example, to perform the frequency calculation, the compliance detector 214 references the binary values indicative of whether a distance difference was detected by the distance comparator 212 and stored in the memory 208. The binary values are timestamped to indicate when an indication of compliance (e.g., a difference in current and previous distances as indicated by a logic '1') or non-compliance (e.g., no difference between current and previous distances as indicated by a logic '0') is detected. The compliance detector 214 sums the number of indications of compliance detected during the given time period, as defined by the timestamps, to determine the frequency.

The compliance detector 214 then translates the frequency into a percentage according to, for example, a lookup table programmed into the compliance detector 214 (block 434). The values of the lookup table are based on, for example, an expected correlation (e.g., according to one or more previous studies) between frequency of distance changes and the probability that a person is carrying the portable meter 110. The percentage acts as an initial representation of the likelihood that the portable device 110 is being carried. As described below, the percentage can be adjusted according to other aspects of the information gathered by the sensors 210*a-c* and analyzed by the distance comparator 212.

In the illustrated example, the compliance detector 214 analyzes the magnitude and polarity of distance differences generated by the distance comparator 212 and adjusts the likelihood percentage accordingly (block 436). For example, when one of the comparison results received from the distance comparator 212 includes a distance difference of a large magnitude (e.g., greater than one half meter), the compliance detector 214 of the illustrated example interprets such information as an indication that the portable meter 110 was either being attached to an object (e.g., a belt of the panelist 122) or removed therefrom. In such instances, the polarity of the distance difference received from the distance comparator 212 indicates whether the portable meter 110 was attached to the object or removed therefrom. In the illustrated example, when the polarity of the distance difference is positive, the compliance detector 214 determines that the portable meter 110 was likely removed from an object. On the other hand, in the illustrated example, when the polarity of the distance difference is negative, the compliance detector 214 determines that the portable meter 110 was likely attached to an object. In other instances, when the magnitude of the distance difference is small (e.g., two millimeters), the polarity of the compliance may not be considered in the likelihood calculation.

To adjust the percentage according to, for example, the analysis of the magnitude and/or polarity of the differences, the compliance detector 214 of the illustrated example adds or subtracts points from the likelihood percentage according to a set of pre-programmed rules. For example, a distance difference of a large magnitude having a negative polarity (e.g., indicative of the portable meter 110 being clipped onto a belt) followed shortly (in time) by a plurality of distance differences of smaller magnitudes causes the compliance detector 214 to substantially increase the likelihood percentage. In contrast, a distance difference of a large magnitude having a positive polarity (e.g., indicative of the portable meter 110 being detached from a belt) followed shortly (in time) by a plurality of determinations that the distance between the portable meter 110 and a nearby object has not changed causes the compliance detector 214 to substantially decrease the likelihood percentage.

In the illustrated example of FIG. 4B, the compliance detector 214 performs the likelihood calculation with respect to each individual status sensor 210*a-c* and stores the likelihood calculation in the memory 208 (FIG. 2) (block 438). In other words, a first likelihood of the portable meter 110 being carried by the panelist 122 is calculated and stored according to the information gathered by the sensor labeled with reference numeral 210*a*; a second likelihood of the portable meter 110 being carried by the panelist 122 is calculated and stored according to the information gathered by the sensor labeled with reference numeral 210*b*; and a third likelihood of the portable meter 110 being carried by the panelist 122 is calculated and stored according to the information gathered by the sensor labeled with reference numeral 210*c*.

Additionally, in the illustrated example of FIG. 4B, the compliance detector 214 also includes one or more algorithms to calculate a cumulative likelihood of the portable meter 110 being carried by the panelist 122 (block 440). In the illustrated example, the compliance detector 214 calculates the average of the individual likelihoods associated with each sensor 210*a-c*. In other examples, the individual likelihoods calculated for each status sensor 210*a-c* are treated independently (e.g., not combined to form a cumulative likelihood).

In the illustrated example, if the calculated cumulative likelihood is below a threshold (block 442), the compliance detector 214 generates a message regarding the detection of non-compliance to be conveyed (e.g., via the display 204 of FIG. 2, via an automatically generated email or letter, as a beep or other audio event, etc.) to the panelist 122 and/or to the media measurement entity that issued the portable meter 110 (block 444). The media measurement readings taken by the media detector 206 during the non-compliant time period are then not credited. Otherwise, when the cumulative likelihood is greater than or equal to the threshold (block 442), media measurement readings taken by the media detector 206 during the corresponding period of time are credited as valid (block 446). In instances in which a cumulative likelihood is not calculated (e.g., the individual likelihoods associated with each sensor 210*a-c* are treated independently), if any of the likelihoods associated with any of the sensors 210*a-c* exceed or meet a threshold (which is typically different from the threshold of block 442), the compliance detector 214 may credit the corresponding media measurement readings as valid. Control then returns to block 404 of FIG. 4A.

Figure 5:
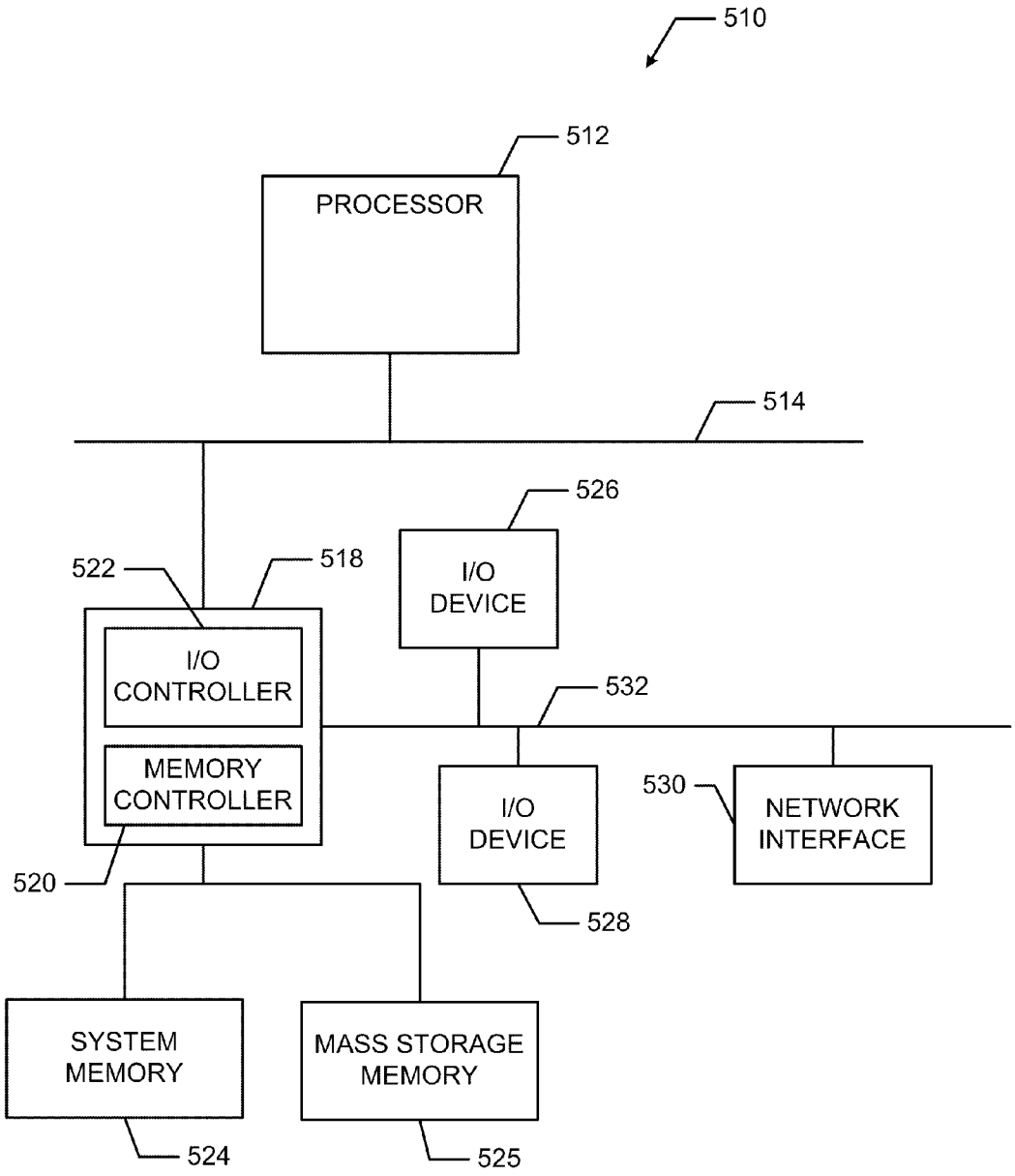
FIG. 5 is a block diagram of an example processor system that may be used to execute the machine readable instructions of FIGS. 4A and/or 4B to implement the example portable meter of FIG. 2.

FIG. 5 is a block diagram of an example processor system 510 that may be used to execute the instructions of FIGS. 4A and/or 4B to implement the example portable meter 110 of FIGS. 1, 2 and 3. As shown in FIG. 5, the processor system 510 includes a processor 512 that is coupled to an interconnection bus 514. The processor 512 may be any suitable processor, processing unit or microprocessor. Although not shown in FIG. 5, the system 510 may be a multi-processor system and, thus, may include one or more additional processors that are different, identical or similar to the processor 512 and that are communicatively coupled to the interconnection bus 514.

The processor 512 of FIG. 5 is coupled to a chipset 518, which includes a memory controller 520 and an input/output (I/O) controller 522. The chipset 518 provides I/O and memory management functions as well as a plurality of general purpose and/or special purpose registers, timers, etc. that are accessible or used by one or more processors coupled to the chipset 518. The memory controller 520 performs functions that enable the processor 512 (or processors if there are multiple processors) to access a system memory 524 and a mass storage memory 525.

The system memory 524 may include any desired type of volatile and/or non-volatile memory such as, for example, static random access memory (SRAM), dynamic random access memory (DRAM), flash memory, read-only memory (ROM), etc. The mass storage memory 525 may include any desired type of mass storage device including hard disk drives, optical drives, tape storage devices, etc.

The I/O controller 522 performs functions that enable the processor 512 to communicate with peripheral input/output (I/O) devices 526 and 528 and a network interface 530 via an I/O bus 532. The I/O devices 526 and 528 may be any desired type of I/O device such as, for example, a keyboard, a video display or monitor, a mouse, etc. The network interface 530 may be, for example, an Ethernet device, an asynchronous transfer mode (ATM) device, an 802.11 device, a DSL modem, a cable modem, a cellular modem, etc. that enables the processor system 510 to communicate with another processor system.

While the memory controller 520 and the I/O controller 522 are depicted in FIG. 5 as separate blocks within the chipset 518, the functions performed by these blocks may be integrated within a single semiconductor circuit or may be implemented using two or more separate integrated circuits.

Although certain methods, apparatus, systems, and articles of manufacture have been described herein, the scope of coverage of this patent is not limited thereto. To the contrary, this patent covers all methods, apparatus, systems, and articles of manufacture fairly falling within the scope of the appended claims either literally or under the doctrine of equivalents.

What is claimed is:

1. A portable audience measurement device, comprising:

a media detector carried by a housing to collect media exposure data;

a distance comparator to compare a first distance between the housing and an object at a first time and a second distance between the housing and the object at a second time; and a compliance detector to validate the media exposure data based on the comparison of the distance comparator.

2. A portable device as defined in claim 1, wherein the compliance detector is to validate the media exposure data when the comparison indicates that the portable device was being carried by a person when the media exposure data was collected.

3. A portable device as defined in claim 1, wherein the media exposure data comprises at least one of a signature or an identification code to which the device is exposed.

4. A portable device as defined in claim 1, wherein the compliance detector is to discard the comparison when a magnitude of a difference between the first and second distances does not meet a threshold.

5. A portable device as defined in claim 1, further comprising a distance detector to calculate the first distance and the second distance based on an output of a sensor.

6. A portable device as defined in claim 5, wherein the sensor comprises at least one of an infrared sensor, an optical sensor, or an emitter-detector pair.

7. A portable device as defined in claim 1, further comprising a user interface to communicate information related to compliance with an agreement to carry the portable device to a person.

8. A portable device as defined in claim 1, wherein the object is a person, an article of clothing being worn by the person, a belt being worn by the person, or a purse being carried by the person.

9. A portable device as defined in claim 1, wherein the compliance detector is to calculate a first likelihood that the portable device is being carried by a person based on the comparison.

10. A portable device as defined in claim 9, wherein the compliance detector is to calculate a second likelihood that the portable device is being carried by the person based on a second comparison, and the compliance detector is to combine the first and second likelihoods to calculate a cumulative likelihood that the portable device is being carried by the person.

11. A method of detecting carrying of a portable audience measurement device, comprising:

collecting media exposure data;

determining, using a sensor, a first distance between a housing including the sensor and a person, an article of clothing being worn by the person, a belt being worn by the person, or a purse being carried by the person at a first time;

determining, using the sensor, a second distance between a housing including the sensor and the person, the article of clothing, the belt, or the purse at a second time; and validating the media exposure data based on a comparison of the first and second distances.

12. A method as defined in claim 11, further comprising validating the media exposure data when the comparison indicates that the portable device was being carried by the person when the media exposure data was collected.

13. A method as defined in claim 11, further comprising discarding the comparison when a magnitude of a difference between the first and second distances does not meet a threshold.

14. A method as defined in claim 11, wherein the sensor comprises at least one of an infrared sensor, an optical sensor, or an emitter-detector pair.

15. A method as defined in claim 11, further comprising communicating information related to compliance with an agreement to carry the portable device to the person.

16. A method as defined in claim 11, further comprising calculating a first likelihood that the portable device is being carried by the person based on the comparison.

17. A method as defined in claim 16, further comprising calculating a second likelihood that the portable device is being carried by the person based on a second comparison, and combining the first and second likelihoods to calculate a cumulative likelihood that the portable device is being carried by the person.

18. A compliance detector to detect compliance with an agreement to carry a portable device, comprising:

a processor to:

receive a first comparison result corresponding to a difference between a first distance reading taken at a first time and a second distance reading taken at a second time, the first and second distance readings respectively corresponding to distances between the portable device and a person;

calculate a likelihood that the portable device is being worn by the person based on the first comparison result; and determine whether media exposure data collected by the portable device is valid based on the likelihood.

19. A compliance detector as defined in claim 18, wherein the likelihood is calculated based on a combination of the first comparison result and a second comparison result corresponding to a difference between the second distance reading taken at the second time and a third distance reading taken at a third time.

20. A compliance detector as defined in claim 18, further comprising a sensor to collect the first and second distance readings, the sensor comprising at least one of an infrared sensor, an optical sensor, or an emitter-detector pair.

* * * * *